US005397018A

United States Patent [19]

Mader

[11] Patent Number: 5,397,018

[45] Date of Patent: Mar. 14, 1995

[54] TENNIS BALL HANDLING SYSTEM

[76] Inventor: Paul-Joachim Mader, Arminstrasse 92, 4200 Oberhausen 12, Germany

[21] Appl. No.: 74,440

[22] Filed: Jun. 9, 1993

[30] Foreign Application Priority Data

Jun. 10, 1992 [DE] Germany ..... 42 18 922.5

[51] Int. Cl.[6] ..... A47F 1/00

[52] U.S. Cl. ..... 221/102; 221/135; 221/266; 221/283; 383/3; 206/315.9; 206/213.1

[58] Field of Search ..... 221/278, 135, 266, 283, 221/102, 97; 206/315.9, 579, 213.1; 383/23, 24, 3, 100; 273/610

[56] References Cited

U.S. PATENT DOCUMENTS

| | | | |
|---|---|---|---|
| Re. 32,308 | 12/1986 | Nattrass | 383/24 |
| 988,163 | 3/1911 | Barnett | 383/23 |
| 1,911,125 | 5/1933 | Miller | 206/315.9 |
| 2,712,394 | 7/1955 | Koschatzky et al. . | |
| 3,228,167 | 1/1966 | Schmidt | 383/3 |
| 3,521,806 | 7/1970 | Esty | 383/3 |
| 4,019,629 | 4/1977 | Dubner et al. . | |
| 4,101,029 | 7/1978 | Feinberg et al. . | |
| 4,564,107 | 1/1986 | Heitzenroder et al. | 383/3 |
| 4,638,923 | 1/1987 | Mines | 221/266 |
| 4,712,712 | 12/1987 | Garden | 221/266 |

FOREIGN PATENT DOCUMENTS

| | | | |
|---|---|---|---|
| 3632989 | 3/1988 | Germany | 273/61 R |
| 4001610 | 7/1991 | Germany | 205/315.9 |
| 9201471 | 6/1992 | Germany . | |

*Primary Examiner*—H. Grant Skaggs
*Attorney, Agent, or Firm*—Sixbey, Friedman, Leedom & Ferguson; David S. Safran

[57] ABSTRACT

A tennis ball handling system in which a first storage container (1) for many tennis balls (2) is filled at the tennis ball producer with new tennis balls suitable for play, is transported to an installation site, such as a sporting goods store, tennis facility, etc. and installed at the installation site, a second storage container for many tennis balls is filled at the installation site with used tennis balls that are no longer suitable for play and in which the used balls are transported back to the tennis ball producer or to a recycling operation and emptied there, and reusable player's storage containers that can be bought, rented, borrowed in a deposit system or acquired at no cost by the player, are filled with a small number of new tennis balls (2) that are removed from the first storage container (1) for use by the tennis player, and from which used tennis balls (2) that are no longer suitable for play are emptied by the player into the second storage container at the installation site. Preferably, the tennis balls are maintainable under an overpressure in the first storage container and the player's storage container.

15 Claims, 3 Drawing Sheets

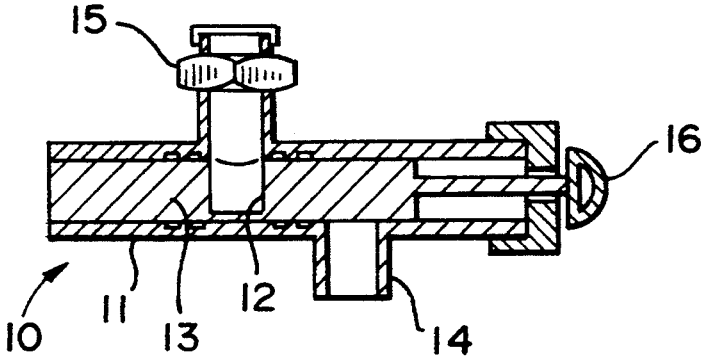
FIG. 4
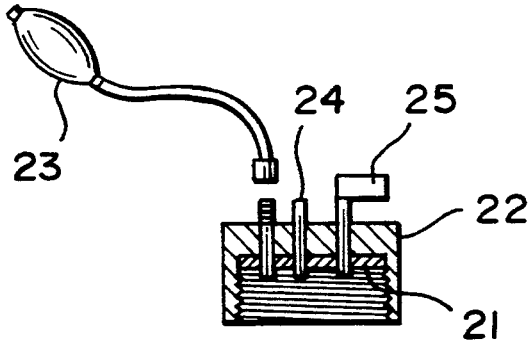
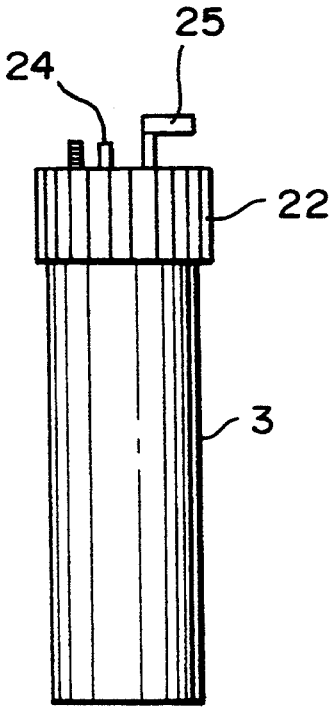
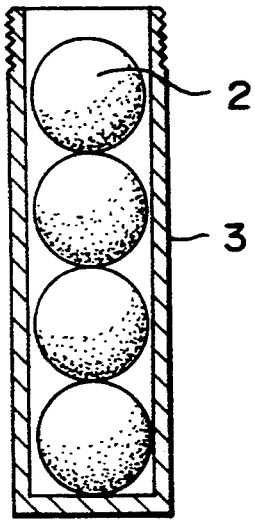
FIG. 6
FIG. 5

TENNIS BALL HANDLING SYSTEM

BACKGROUND OF THE INVENTION

1. Field of the Invention

This invention relates to a tennis ball handling system. That is, to a system with which tennis balls can be transported, stored, used, and optionally, reused.

2. Description of Related Art

Tennis balls, during production, are an expensive and, as waste, a problematic product. Currently, tennis balls are produced in the factory, packaged in small numbers, for example, six balls apiece, in packaging made of cardboard, plastic, and/or metal, and are passed on this way to distribution channels. The most common packaging today is a tin can for four or six tennis balls that, once opened, is closed with a plastic lid. When the tennis balls have been used to the point that they are no longer suitable for play, they are usually thrown away together with the packaging.

It is also known that packaging cans for tennis balls with new tennis balls in them are hermetically pressure sealed at the factory, with increased internal pressure; the usual internal pressure of such packages, which involve mainly tin cans, is about 1.0 bar. This increases the storage time for the tennis balls. However, as soon as such tennis balls are begun to be used they are and they remain subject solely to normal atmospheric pressure.

In an attempt to extend the life of tennis balls, some players invest in a ball-pressurizing storage container in order to store the balls under an increased pressure. Typically, such containers are formed of a pair of telescoping container halves that have a matched threading and one of which carries an o-ring pressure seal. The container halves are sized and the length of their threading set so that, by screwing the container halves together with a number of tennis balls inside, the air in the container is compressed without compressing the tennis balls themselves.

SUMMARY OF THE INVENTION

The object of the invention is to provide a more environmentally friendly tennis ball handling system that takes into consideration the special requirements of tennis balls.

The tennis ball handling system according to the invention utilizes a first storage container for many tennis balls that is filled with new tennis balls suitable for play at the tennis ball producer, and is transported to an installation site—sports store, tennis facility—where it is installed. Preferably, a second storage container for many tennis balls is provided at the installation site, and when it is filled with used tennis balls that are no longer suitable for play, is transported back to the tennis ball producer or a recycling operation and emptied there. Furthermore, reusable storage containers for a small number of tennis balls, that can be bought, rented, borrowed by a deposit system or acquired at no cost by the player, are provided for use by the tennis player. Used tennis balls that are no longer suitable for play are emptied by the player out of the player's storage container, preferably, into the second storage container at the installation site, and new tennis balls suitable for play are removed from first storage container and filled into the player's storage container.

The tennis ball handling system according to the invention solves the above-indicated object surprisingly simply, namely, by turning away from the system, known up to now, of small packages of tennis balls. The latter are retained only as player's storage containers, but equipped to be used over the long term, the rest of the tennis ball handling system operates only with large containers. The overall recycling problem is, thus, solved in one stroke considerably more effectively than when the small packages, themselves, with used tennis balls, are supplied, by sorted waste collection, for reuse.

According to the invention, it has been recognized that, with the tennis ball handling system according to the invention, a condition has been provided for keeping tennis balls under pressure for the long term, which drastically increases their lifetime and playing time. But, beyond this technical effect, also a psychological effect is achieved, namely, a plausible argument is realized for tennis players, and for merchants and producers, for the introduction of the new tennis ball handling system, and clearly increasing its acceptance.

These and further objects, features and advantages of the tennis ball handling system according to the present invention will become apparent from the following description when taken in connection with the accompanying drawings which, for purposes of illustration only, show several embodiments in accordance with the present invention.

BRIEF DESCRIPTION OF THE DRAWINGS

FIG. 4 is a cross-sectional view of the tennis ball pressure lock of FIG. 3;

FIG. 5 illustrates a player's storage container in a side view; and

FIG. 6 is an exploded cross-sectional view of the player-storage container of FIG. 5.

DETAILED DESCRIPTION OF THE PREFERRED EMBODIMENTS

Figure 1:
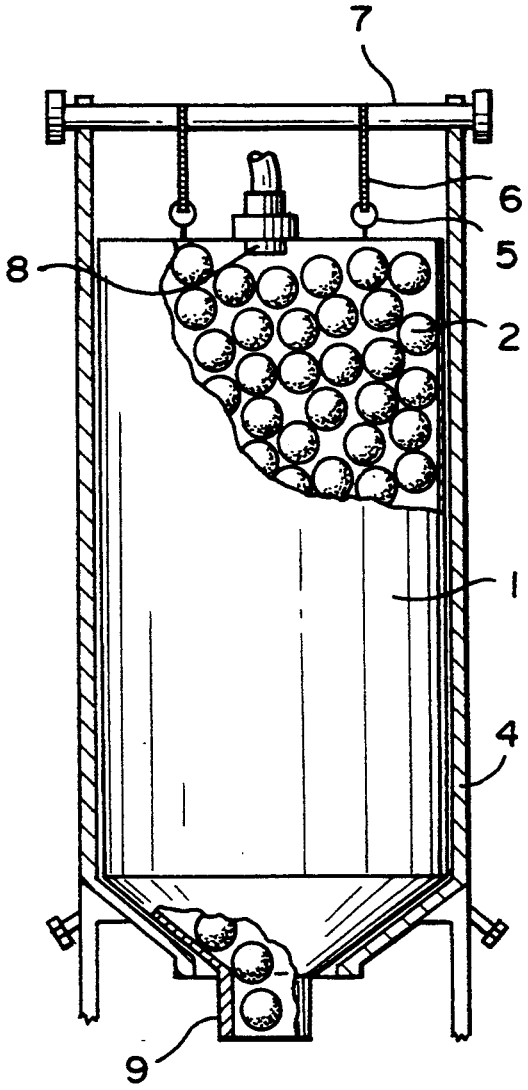
FIG. 1 shows a first storage container for tennis balls, partially in section.

FIG. 1 shows a tennis ball handling system according to the invention which comprises, firstly, a first, new ball, storage container 1 for tennis balls 2 that is filled by the tennis ball producer with numerous, e.g., several hundred, new tennis balls suitable for play, and is transported to an installation site, such as a sporting goods store, tennis facility, etc., whereat is installed. At the installation site, a second storage container, not represented here, and not necessarily having to look like first storage container 1, can be located in proximity to the storage container 1. The second storage container is present to collect used tennis balls that are no longer suitable for play and to supply them back to the tennis ball producer or to a recycling operation.

Another essential component of the tennis ball handling system according to the invention is the reusable player's storage container 3 represented in FIG. 5 and 6. Since the player's storage container 3 is constantly used by the player, i.e., is not to be thrown away, it can be constructed more expensively and sturdily. The player should be able to buy, rent, or borrow (with a deposit or other security), the player's storage container 3. This is recommended because of the way the system works. Of course, basically it would also work to make such player's storage containers 3 available at no cost for introduction of the system. In any case, it is essential that this player's storage container 3 be used by the player for a small number of tennis balls 2, i.e., that it replace the previous disposable ball can, which itself is indeed entirely functional.

Now, the tennis ball handling system functions so that used tennis balls 2 that are no longer suitable for play are emptied by the player out of player's storage container 3 into the second storage container at the installation site. Then, new tennis balls 2, that are suitable for play, are taken out of first storage container 1, and again, filled into the player's storage container 3. In the final analysis, the system is tailored for a piecemeal sale of tennis balls and, with the player's storage container 3, an especially suitable receiving medium for the tennis ball is made available to the tennis player.

It was explained, above, that the second storage container for receiving tennis balls 2 to be recycled can be designed completely differently from first storage container 1. In particular, with the second storage container, the limiting conditions that are to be observed, or in any case are recommended to be observed, with first storage container 1 for new tennis balls 2, are not to be observed. This will be discussed later on. But, it is especially suitable if both storage containers are made structurally identical and can be interchanged because, then, the storage containers can be used circulated in a loop between the producer plant and the installation site.

As a material for storage container 1, basically, conventional container materials are suitable. It is especially advantageous if storage container 1 is made of plastic, rubber or a plastic-rubber mixture. For a space-saving return of an empty storage container 1, a collapsible embodiment of storage container 1 having sufficient rigidity when erected an be achieved, for example, by the use flexible-foldable material with remove inserts. Rigid plastic containers made of polyamide or other thermoplastic materials would also be suitable.

Figure 2:
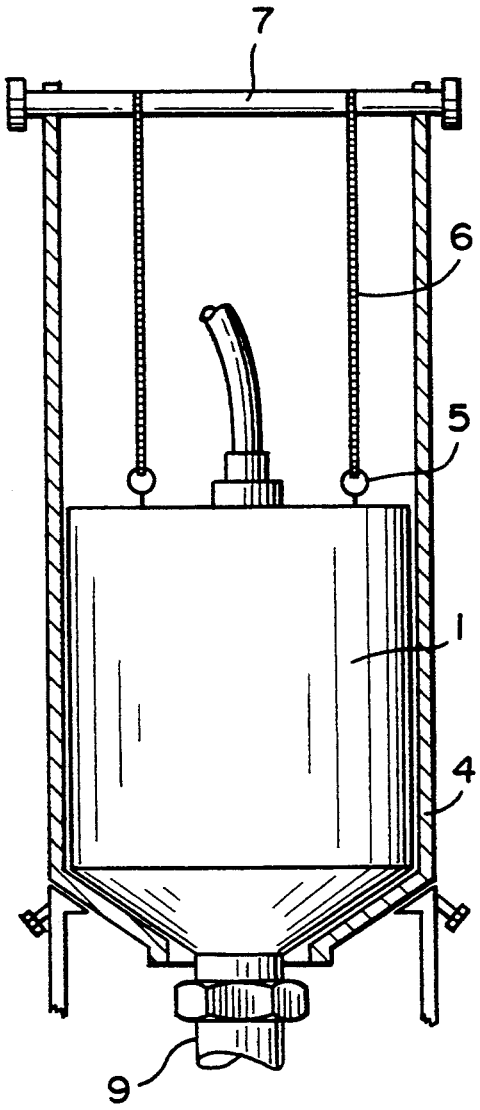
FIG. 2 shows another embodiment of a tennis ball storage container in a receiving container or receiving carrier.

Now, the preferred embodiment for an installation site unit, represented in FIGS. 1–3, will be described. At the installation site, a receiving receptacle 4, remaining there and made of rigid material, such as plastic, metal and/or wood, is provided, into which storage container 1 can be inserted, in particular, hung. The varying functions of a sensible, easily achievable installation at the installation site, on the one hand, and for transporting as little weight as possible, on the other hand, make a separation advisable. This concept serves that purpose. It can be seen that, in the embodiment represented, storage container 1 is hung in receiving receptacle 4. For this purpose, on the top side of storage container 1, there are holding loops 5, into which holding ropes or straps 6 are detachably inserted. Holding ropes 6 are secured on a holding bar 7 as a carrying bar on the top side of receiving container 4. The length of holding ropes 6 can be adjusted to the height of the storage container 1; compare container 1 of FIG. 2 with that in FIG. 1. While the storage containers 1 vary considerably in height, the diameter and basic shape thereof is identical in both cases, so that, in this way, one and the same receiving receptacle 4 can be used for storage container 1 of a different capacity.

FIG. 1 makes it clear that, according to the preferred teaching, storage container 1 has an upper filling opening 8 and a lower discharge opening 9. Basically, it would be possible to equip storage container 1 also with only a single filling and discharge opening. In such a case, for filling at the producer, storage container 1 would be arranged with the filling and discharge opening on top while, at the installation site, in receiving receptacle 4, the filling and discharge opening would, then, be located on the bottom of storage container 1, so that tennis balls 2 could fall out of storage container 1 by the force of gravity.

Naturally, at discharge opening 9, shown in FIG. 1, there must be a removal device, made in whatever way, for the desired number of tennis balls 2. The latter should, if possible, make it possible to remove tennis balls 2 individually. In any case, it is to be assured that tennis balls 2 cannot exit storage container 1 in an uncontrolled way. If possible, the removal device for tennis balls 2 can be coupled with a locking mechanism, optionally a coin insertion mechanism can also be provided, so that removal of a certain number of tennis balls 2 is made possible when a certain amount of money is inserted.

The tennis ball handling system according to the invention is, as such, already extremely environmentally friendly. But this tennis ball handling system will have achieved another, qualitatively important step if, at any rate, first storage container 1 is made pressure-sealed, i.e., is able to hold a moderate internal overpressure of, for example, 1.0 to 1.5 bars for a certain minimum time and storage container 1, after being filled with new tennis balls 2 suited for play, is supplied with the increased internal pressure and closed, pressure-sealed. Precisely for a large amount of tennis balls 2, storage under internal overpressure is especially advantageous, since tennis balls 2 can thus be stored for a very long time. A long-term storage of tennis balls 2 under increased pressure results in a considerably longer lifetime for tennis balls 2, with optimal exploitation of all possibilities, the consumption of tennis balls could possibly be reduced, in this way alone, by about 20%.

Figure 3:
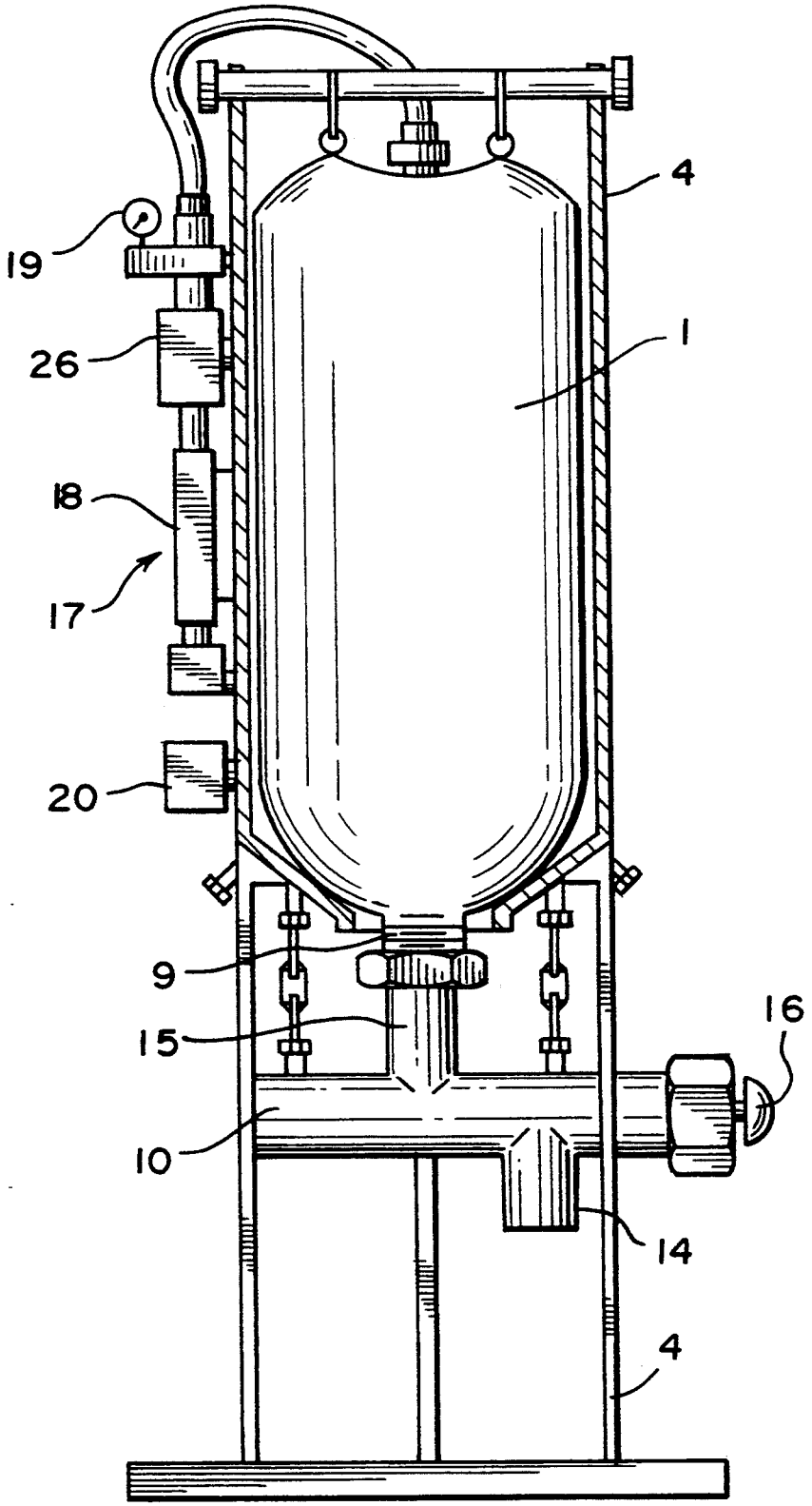
FIG. 3 is a detailed representation of a storage container with a tennis ball pressure lock for a receiving container according to the invention.

According to the invention, as can be seen from FIG. 3, it is further provided that, at the installation site, at discharge opening 9 of first storage container 1, a tennis ball pressure lock 10 is attached, by which tennis balls 2 can be removed from the storage container, with only limited pressure loss from the container. Pressure lock 10 is made of metal and is hung directly on receiving receptacle 4. It is connected by a threaded connection to discharge opening 9 of storage container 1. There are numerous possibilities for the more precise embodiment of this pressure lock 10.

A preferred embodiment of pressure lock 10 is shown in FIG. 3, where pressure lock 10 is made as a cylinder-piston arrangement with a piston 13 that is guided in a cylinder 11 in an air tight sealed manner. Piston 13 has a laterally open ball receptacle 12, and can preferably be pivoted around its own lengthwise axis. A discharge pipe 14 is placed on cylinder 11, offset axially relative to an entry pipe 15 that is connected at discharge opening 9 of storage container 1. Thus, a tennis ball that has fallen into ball receptacle 12 in piston 13 can be allowed to fall downward and out of discharge pipe 14 by axially pulling-out piston 13 via a reduced diameter handle 16 which extends through an end cap of cylinder 11 (the axial distance between pipes 14 and 15 should match the distance piston 13 can be pulled out) and turning it by 180° around its lengthwise axis. However, it would also be possible to make ball receptacle 12 extend diametrically through piston 13, so that a mere pulling out of piston 13, without turning, would suffice.

Many other alternatives for the embodiment of the removal device, in the form of a pressure lock 10 are conceivable, and in any case, the retention of the represented system of a "lock" is recommended.

Even if ball removal by pressure lock 10 in the embodiment represented generally precludes a sudden considerable pressure loss in storage container 1, the internal overpressure in storage container 1 still decreases a little each time a tennis ball is removed. Here, according to a preferred teaching represented in FIG. 3, it is advisable that, at least at the installation site, a pressure compensation device 17 be connected to storage container 1, preferably at its filling opening 8, to maintain an increased pressure on the tennis balls in it. Pressure compensation device 17 can be controlled automatically, it can also be turned on and off again manually. The simplest possibility would consist in providing pressure compensation device 17 with a hand pump and, after a series of ball removals, the pressure in storage container 1 could be pumped back up to the proper internal overpressure.

The embodiment represented in FIG. 3 has, in contrast, a motor-driven compressor 18. A manometer 19 is used for measurement and display of the internal pressure in storage container 1, the latter can be determined simultaneously with pressure sensor, so that the internal pressure in storage container 1 can be automatically readjusted by an automatic pressure measurement and adjusting unit 20 provided here for controlling compressor 18. Incidentally, the control connection lines in the system are not represented here; although, they exist and can be achieved in a conventional manner.

FIG. 3 also shows that a humidity filter 26 can be added to pressure compensation device 17 to keep the air in storage container 1 dry. Minimizing of moisture with the storage container 1 also contributes to an increased lifetime for the stored new tennis balls 2.

If an increased internal pressure is maintained in the storage container 1, then, as already explained above, that increases the lifetime of the tennis balls considerably. But, the system according to the invention offers another possibility for increasing the lifetime of the tennis balls 2, yet again. Since namely, according to the system according to the invention, player's storage container 3 is not a disposable item, but is used by the player for a prolonged period, there is room here for a more expensive configuration of player's storage container 3. This, in turn, makes it possible for player's storage container 3 to be made pressure-sealed, i.e., able to hold a moderate internal overpressure of, for example, 1.0 to 1.5 bars for a certain minimum time, and player's storage container 3 can be pressure-sealed in each case after being filled with tennis balls 2. While, as noted, initially, ball-pressurizing storage containers which enable a few balls to be stored by a player under an increased pressure are known, a preferred form for such a container, for use as a player's storage container 3 as part of the system of the present invention, is shown with four tennis balls 2 in it in FIGS. 5 and 6.

The preferred player's container 3 has a cover 22 that is provided with an internal seal 21 and which can be screwed onto a thread on the cylindrical body of the storage container 3 to closed the open end thereof. In this way, player's storage container 3 can be closed pressure-sealed. The player's storage container 3 can be connected to a pressure source or is provided with a hand pump 23 to increase the internal pressure in player's storage container 3. A hand pump 23 on player's storage container 3 has the advantage that it can constantly be taken along, so that repumping in player's storage container 3 can be performed at any time by the player.

The embodiment represented in FIGS. 5 and 6 is further distinguished by the provision of a pressure control valve 24, adjusted to the preferred internal pressure, and a manometer 25. Pressure control valve 24 begins to let out the internal pressure when it exceeds its setpoint. Manometer 25, also provided here, makes it possible to visually monitor the internal pressure, if no tennis is played for a prolonged period. Otherwise, it would naturally suffice to "blindly" repump from time to time with hand pump 23, until pressure control valve 24 opens up.

The tennis ball handling system according to the invention has many advantages. Apparent are the advantages of the lessened burden on the environment, since a specially developed multipath system for tennis balls is involved here. Transport costs are reduced, unnecessary trips by transport vehicles are eliminated. The advantages of the multipath packaging being eliminated are obvious.

The containers for tennis balls standing at the installation site offer advertising space and, further, can be combined extremely well with an automatic removal device, optionally also, with a coin insertion device. The producer/installer connection is intensified. Long-term customer relations can be supported. The tennis player is put in a position of being able to acquire any number of tennis balls, for big users, such as tennis teachers, entire storage containers can possibly be reserved in which a large number of tennis balls is filled nightly and stored under pressure. For the tennis player himself, the increase in lifetime due to keeping the tennis balls under increased pressure is likely to be an especially important argument. To this is naturally added the positive impression of environmentally friendly handling by the sport of tennis.

In evaluating this invention it is to be taken into account that each year, in the U.S., Germany, and numerous other countries, many millions of tennis balls are consumed and they generate many thousands of tons of waste that cannot practically be included in recycling. By the present invention, not only does the recycling of used tennis balls become more practical but, another source of waste, the disposable cans in which they currently are sold, is eliminated.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Tennis ball handling system, comprising:

a) a first storage container for mass storage of tennis balls and which is filled, at a tennis ball producer, with new tennis balls suitable for play, which is transportable in filled condition to an installation site and which is installable at the installation site for dispensing of tennis balls thereat;

b) a second storage container for mass storage of tennis balls that is fillable at the installation site with used tennis balls that are no longer suitable for play, and which is transportable to a location where it may be emptied; and c) reusable player's storage containers for a small number of tennis balls for use by tennis players;

whereby used tennis balls no longer suitable for play may be emptied by the players out of respective player's storage containers into the second storage container at the installation site, and new tennis balls suitable for play may be removed from the first storage container and filled into the player's storage containers;

wherein at least the first said storage container is formed of a flexible-foldable material;

wherein the first storage container is pressure-sealable for enabling an internal overpressure to be maintained for at least a minimum period of time after being filled with new tennis balls, supplied with the internal overpressure and closed;

and wherein a tennis ball pressure lock is provided for connection to the opening of the first storage container as means by which tennis balls can be removed from the first storage container at the installation site with only a limited pressure loss therefrom.

2. Tennis ball handling system according to claim 1, wherein the first and second storage containers are made identically and can be interchanged.

3. Tennis ball handling system according to claim 2, wherein said flexible-foldable material is a material selected from the group consisting of rubber, plastic and a plastic/rubber mixture.

4. Tennis ball handling system according to claim 1, wherein said flexible-foldable material is a material selected from the group consisting of rubber, plastic and a plastic/rubber mixture.

5. Tennis ball handling system according to claim 1, further comprising a receiving receptacle made of a rigid material, said receiving receptacle being provided at the installation site as a means for removably holding the first storage container.

6. Tennis ball handling system according to claim 5, wherein the first storage container has at least one opening by which it may be filled with tennis balls and by which tennis balls can be discharged.

7. Tennis ball handling system according to claim 5, wherein the first and second storage containers are made identically and can be interchanged; and wherein both of the first and second storage containers are formed of a flexible-foldable material.

8. Tennis ball handling system according to claim 1, wherein the pressure lock comprises a cylinder-piston arrangement having a piston that is guided in a cylinder in an air tight sealed manner, said piston having a laterally open ball receptacle; and wherein said cylinder has a discharge pipe that is axially offset relative to an entry pipe by which the pressure lock is attached to the discharge opening of the storage container.

9. Tennis ball handling system according to claim 8, wherein said ball receptacle opens at one side of said piston and is mounted to pivot around a lengthwise axis thereof to enable it to be shifted between a side of said cylinder at which said entry pipe is located and a side of said cylinder at which said discharge pipe is located.

10. Tennis ball handling system according to claim 1, wherein, at least at the installation site, a pressure compensation device is provided for attachment to the first storage container as a means for increasing the pressure in the first storage container.

11. Tennis ball handling system according to claim 10, wherein the pressure compensation device comprises at least one of a hand pump and a motor-driven compressor.

12. Tennis ball handling system according to claim 11, wherein the pressure compensation device has an automatic pressure measuring and adjusting unit for automatically adjusting the internal pressure by controlling compressor.

13. Tennis ball handling system according to claim 1, wherein the player's storage container has a pressure seal for holding an internal overpressure for at least a minimum period of time after being filled with tennis balls.

14. Tennis ball handling system according to claim 13, wherein the player's storage container has a connector for at least one of a pressure source and a hand pump as a means for enabling the internal pressure in player's storage container to be increased.

15. Tennis ball handling system according to claim 14, wherein the player's storage container is provided with at least one of a pressure control valve having a setpoint internal pressure at which it opens, and a manometer for determining the internal pressure in the player's storage container.

* * * * *